US008079471B2

(12) United States Patent
Tokarski et al.

(10) Patent No.: US 8,079,471 B2
(45) Date of Patent: Dec. 20, 2011

(54) CARTON HAVING PROTECTIVE ELEMENTS

(75) Inventors: John H. Tokarski, Golden, CO (US); Raymond S. Kastanek, Longmont, CO (US)

(73) Assignee: Graphic Packaging International, Inc., Marietta, GA (US)

( * ) Notice: Subject to any disclaimer, the term of this patent is extended or adjusted under 35 U.S.C. 154(b) by 669 days.

(21) Appl. No.: 11/520,127

(22) Filed: Sep. 13, 2006

(65) Prior Publication Data

US 2007/0056869 A1 Mar. 15, 2007

Related U.S. Application Data

(60) Provisional application No. 60/716,896, filed on Sep. 14, 2005.

(51) Int. Cl.
*B65D 65/00* (2006.01)
*B65D 75/00* (2006.01)

(52) U.S. Cl. ..... 206/427; 229/122; 229/199; 229/5.84

(58) Field of Classification Search ..... 206/484, 206/524.3, 427–435, 139–203; 229/117.28, 229/122.34, 89, 91, 5.84, 5.81, 206, 209, 229/5.83

See application file for complete search history.

(56) References Cited

U.S. PATENT DOCUMENTS

| | | | | |
|---|---|---|---|---|
| 300,323 | A * | 6/1884 | Long | 229/91 |
| 1,850,714 | A * | 3/1932 | Gaylord | 206/433 |
| 2,216,339 | A * | 10/1940 | De Reamer | 206/433 |
| 2,314,198 | A * | 3/1943 | De Reamer | 206/433 |
| 2,547,005 | A * | 4/1951 | Herrick et al. | 229/90 |
| 2,676,745 | A | 4/1954 | Geisler | |
| 3,659,772 | A | 5/1972 | Dorsey et al. | |
| 3,785,254 | A | 1/1974 | Mann | |
| 4,034,909 | A | 7/1977 | Toda | |
| 4,187,768 | A | 2/1980 | Suzuki | |
| 4,387,808 | A * | 6/1983 | Dornbusch | 206/432 |
| 4,566,626 | A * | 1/1986 | Wood et al. | 229/122 |
| 4,586,643 | A * | 5/1986 | Halabisky et al. | 229/199 |
| 4,588,390 | A | 5/1986 | Heitele et al. | |
| 4,784,316 | A * | 11/1988 | Crouch | 229/117.13 |
| 5,002,186 | A * | 3/1991 | Cooper | 206/433 |
| 5,021,040 | A * | 6/1991 | Phillips | 493/133 |
| 5,114,013 | A | 5/1992 | Brown et al. | |
| 5,170,934 | A | 12/1992 | Lemoine | |
| 5,407,072 | A * | 4/1995 | Weder et al. | 206/423 |
| 5,564,567 | A * | 10/1996 | Weder | 206/423 |
| 5,775,502 | A * | 7/1998 | Weder | 206/423 |
| 5,975,300 | A * | 11/1999 | Gale | 206/433 |
| 6,527,116 | B1 * | 3/2003 | Gale | 206/427 |
| 6,945,450 | B2 | 9/2005 | Rusnock | |
| 7,624,535 | B2 * | 12/2009 | Schmidt | 47/65.5 |

FOREIGN PATENT DOCUMENTS

| | | |
|---|---|---|
| DE | 8906588 | 8/1989 |
| GB | 934885 | 8/1963 |

* cited by examiner

*Primary Examiner* — Mickey Yu
*Assistant Examiner* — Chun Cheung
(74) *Attorney, Agent, or Firm* — Womble Carlyle Sandridge & Rice, LLP

(57) ABSTRACT

A carton for containing a plurality of articles. The carton has a plurality of panels that extend at least partially around an interior of the carton. The plurality of panels is a top panel, a bottom panel, a first side panel, and a second side panel. At least one of the panels has a protective coating for contact with the articles. The coating is arranged as a plurality of protective elements selectively applied to an interior surface of the at least one panel.

31 Claims, 6 Drawing Sheets

CARTON HAVING PROTECTIVE ELEMENTS

CROSS-REFERENCE TO RELATED APPLICATIONS

This application claims the benefit of U.S. Provisional Application No. 60/716,896, filed on Sep. 14, 2005, the entire contents of which are hereby incorporated by reference as if presented herein in their entirety.

BACKGROUND OF THE INVENTION

This invention relates generally to cartons and more specifically to cartons formed from carton blanks for enclosing a plurality of containers, such as cans or bottles.

Various cartons in the packaging art enclose a plurality of containers, such as cylindrical cans or bottles, for packaging, shipping, displaying, and dispensing. Some of these cartons are constructed of fiber or paperboard, which is a cost-effective material.

During the packaging operation, the containers either are formed into groups and inserted into a carton sleeve made from a blank, or the group is placed on the interior surface of the carton blank and the blank is folded around the group to form the carton. The exterior surface of the carton typically has graphics or logos printed thereon. Sometimes the group of cans or bottles is soaked with water as it is placed into the carton. This can result either from the washing step, filling step or can result from the contents of the container being cold, which causes moisture to condense on the outside of the container. Additionally, known paperboard carton blanks have been laminated on the exterior or outer surface, such as for protecting the ink-based graphics, adding additional graphic layers, adding additional strength or waterproofing the carton. During the packaging operation in which the containers are placed on top of the flat carton blank, the carton blank that supports the container group is conveyed across, for example, rollers, through a continuous motion article packaging machine. As this happens, the containers, for example cans, sometimes spin in place within the article group. This spinning tends to wear the uncoated interior surface of the carton blank. Since the cans also can be wet, the moisture invades or soaks into the paperboard blank from the interior surface, and wicks toward the exterior surface where the graphics printing is located. The presence of moisture in these areas causes degradation not only of the graphics, but also to the carton itself.

Additionally, when containers with residual water or moisture are enclosed within the carton, a humid atmosphere is created. This humidity generally moistens the paperboard where it contacts the cans. After the wet cans or containers contact the substrate or paperboard, moisture wicks through the paperboard fibers to the clay-coated, print surface. In this situation, the wet printed-clay surface contacts conveyor belts and static rails as the package moves through the manufacturing process, such as through a fill line. This contact causes stress at the exterior surface of the carton, with the stress being greatest adjacent to where the cans within the carton contact the interior surface of the carton. At the high stress points, the clay coating can separate from the paperboard fiber, usually in small areas or spots. These places where the clay and/or fibers are removed creates a defect termed "water-induced abrasion", which is also termed "ink picking" since the abrasion removes the ink or printing from the surface of the blank, sleeve, or carton. Ink picking can also occur where the water forms a bubble or bulge at the surface of the ink or graphics. This bubble then comes in contact with the conveyor belt or a static surface during the packaging process to create the ink picking and mar the graphics. Besides creating the problem of ink picking, which damages the appearance of the carton, the humidity can also mold or otherwise corrode the cans in the carton. Without protection, the wetness of the cans can cause a substantial enough amount of wearing that the outside surface of the container becomes structurally damaged, exhibits "can chime" (bulging areas of a can outline macroscopically apparent on the exterior surface of the carton), and/or experiences ink picking.

This visual defect of water based abrasion or ink picking typically occurs where the bottom portion of the cans contact the packaging substrate or paperboard. Uncoated or unlaminated paperboard or clay covered kraft paperboard often abrades when the wet or moisture laden containers are enclosed within a formed carton. Generally, lamination or other coating reduces or controls the impact of any moisture from the containers that could limit the structural integrity of, or damage ink or printing on, the carton. Conventional carton designs will often have an entire surface, typically the exterior surface, of the paperboard carton laminated. However, laminating entire surfaces of the carton is expensive.

Also, if the entire interior surface of the carton is coated and the end flaps are sealed with wet cans enclosed therein, a humid condition is created inside the carton. This humid condition can cause mold to develop on the cans and can develop corrosion on their surfaces.

As an alternative to laminating an entire surface of the carton, only the interior surfaces of the carton in contact with the upper and lower portions of the containers could be laminated. However, while coating the contact surfaces of the interior of the carton could prevent impact abrasion and/or ink picking proximate the surface contacts of the containers, the moisture in the interior of the carton from the containers merely could leak to the sides of the carton to create structural weakening of the uncoated paperboard at the sides.

Accordingly, a need exists for an abrasion resistant coating that addresses successfully the foregoing problems and shortcomings of the prior art. It is to the provision of such a coating that the present invention is primarily directed.

SUMMARY OF THE INVENTION

In general, one aspect of the invention is directed to a carton for containing a plurality of articles. The carton comprises a plurality of panels that extend at least partially around an interior of the carton. The plurality of panels comprise a top panel, a bottom panel, a first side panel, and a second side panel. At least one panel of the plurality of panels comprises a protective coating for contact with the articles. The coating comprises a plurality of protective elements selectively applied to an interior surface of the at least one panel.

In another aspect, the invention is generally directed to a blank for forming a carton. The blank comprises a plurality of panels comprising a top panel, a bottom panel, a first side panel, and a second side panel. At least one panel of the plurality of panels comprises a protective coating. The coating comprises a plurality of protective elements selectively applied to an interior surface of the at least one panel.

In another aspect, the invention is generally directed to a method of protecting a carton. The method comprises providing a blank having a plurality of panels comprising a top panel, a bottom panel, a first side panel, and a second side panel. At least one panel of the plurality of panels is coated with a protective coating including a plurality of protective elements selectively applied to an interior surface of the at least one panel. The blank is formed into a sleeve. A plurality of containers is inserted into the sleeve such that external surfaces of the containers respectively contact the protective elements.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the invention.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present invention generally relates to cartons that contain articles such as containers, bottles, cans, etc. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present invention can accommodate articles of any shape. For the purpose of illustration and not for the purpose of limiting the scope of the invention, the following detailed description describes beverage containers (e.g., metal beverage cans) as disposed within the carton embodiments. In this specification, the terms "lower," "bottom," "upper" and "top" indicate orientations determined in relation to fully erected and upright cartons.

Figure 1:
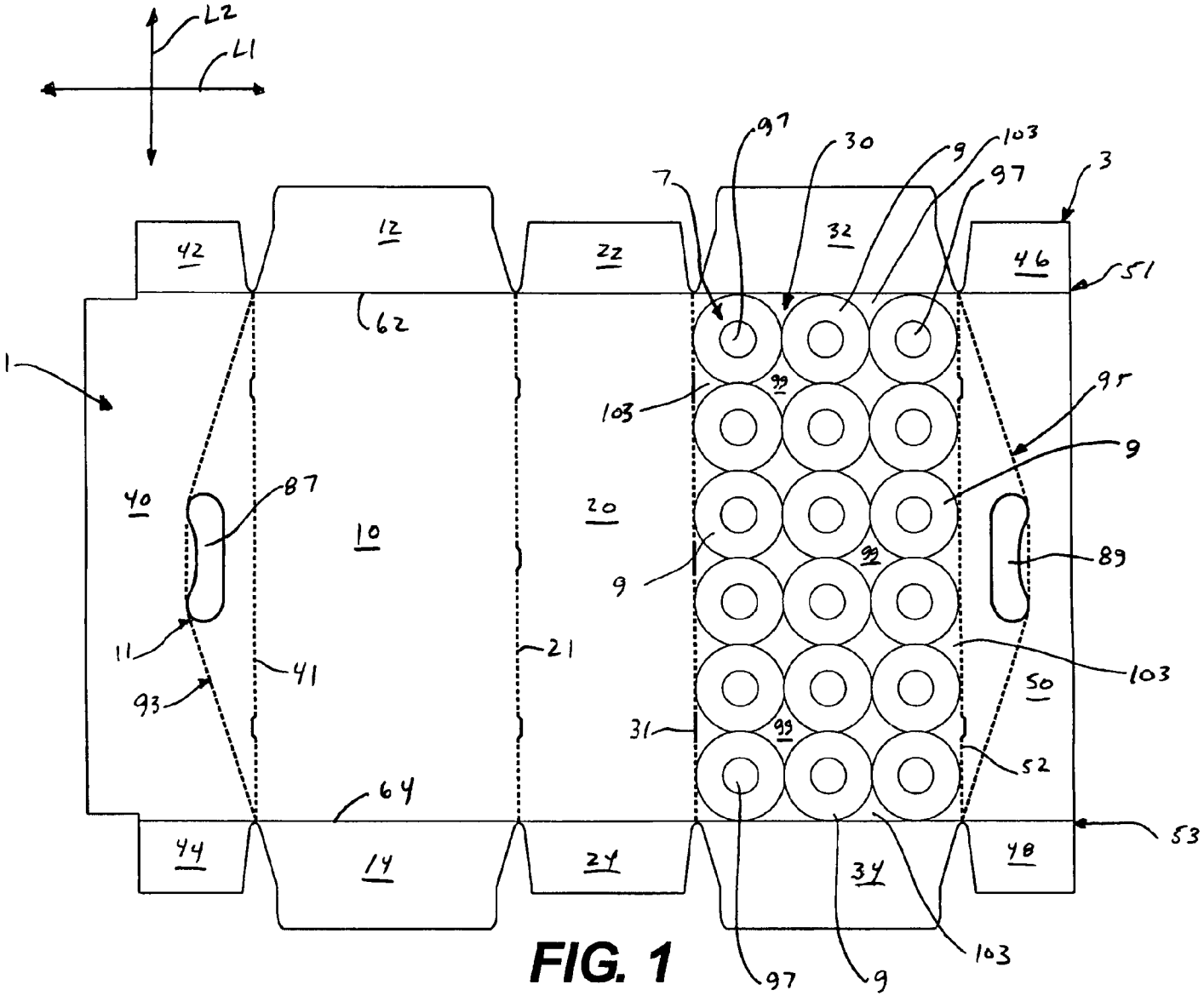
FIG. 1 is a plan view of a blank used to form a carton according to a first embodiment of the invention.
Figure 3:
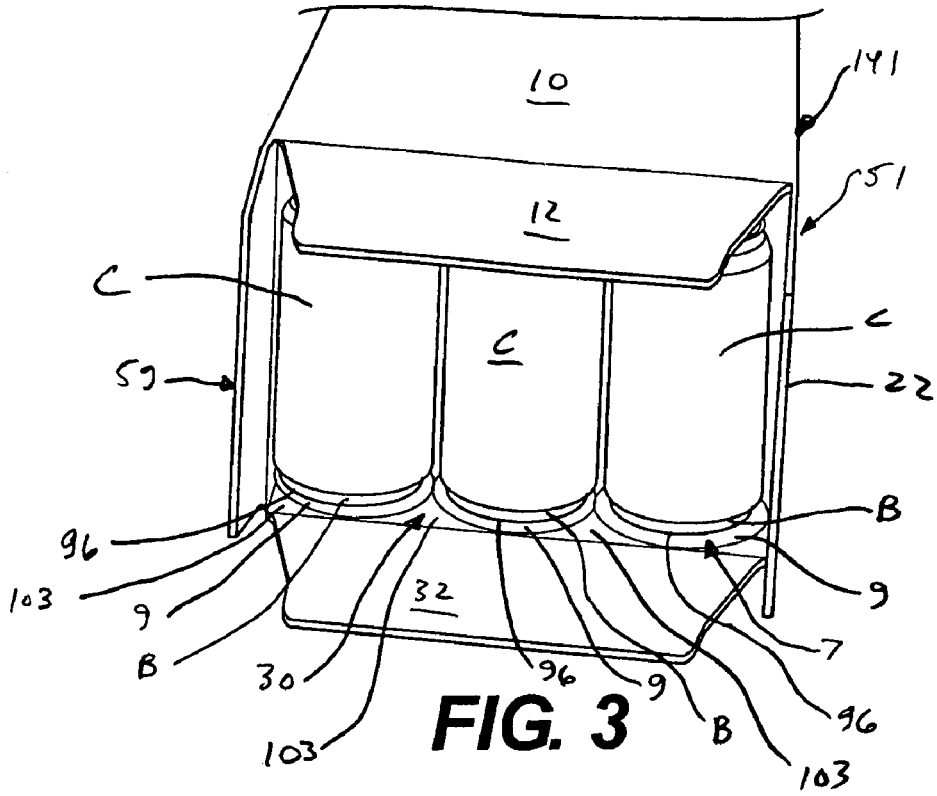
FIG. 3 is a perspective of a first open end of the carton with containers loaded therein.
Figure 2:
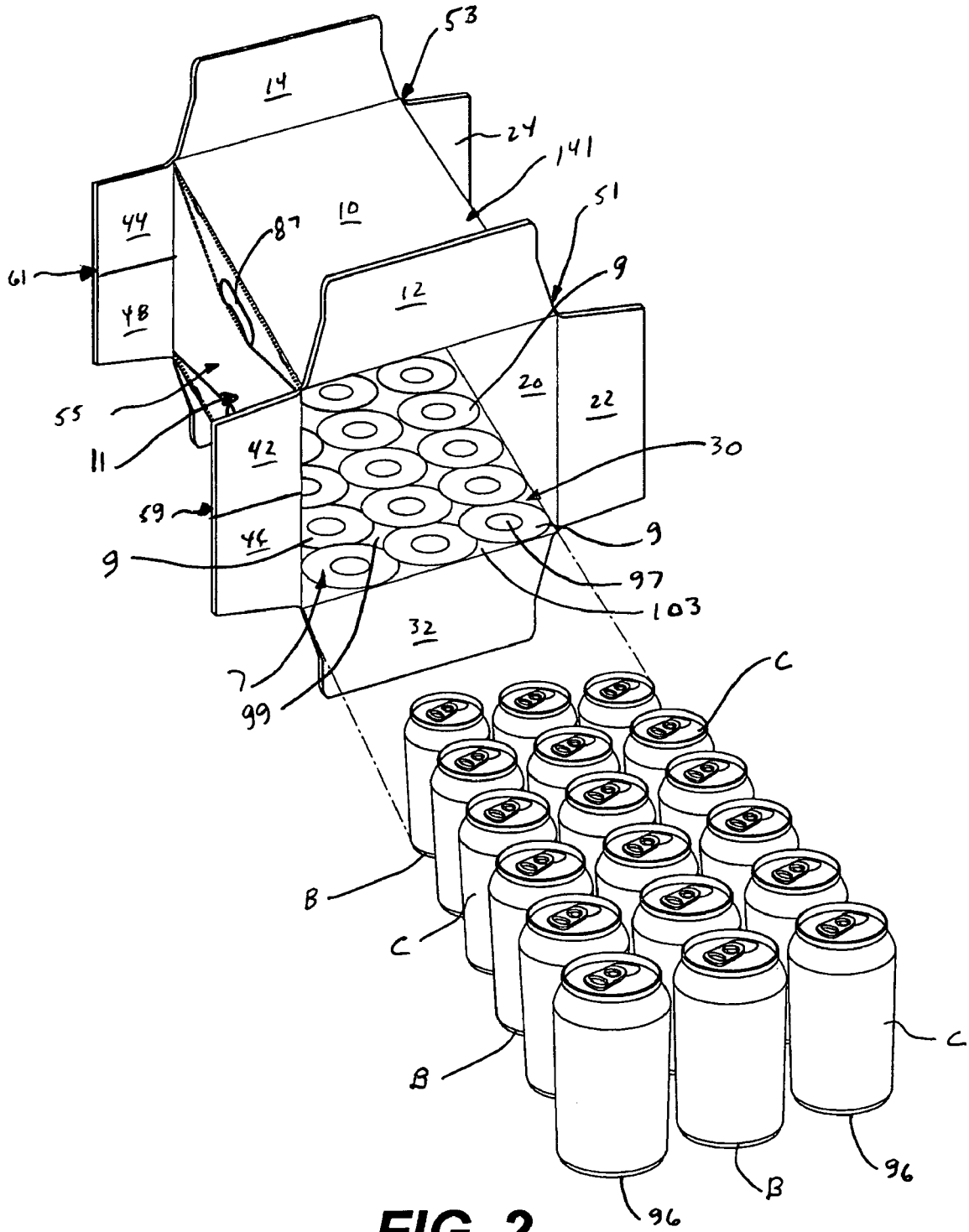
FIG. 2 is a schematic perspective of the carton partially assembled with two open ends and containers positioned for insertion into the carton.
Figure 4:
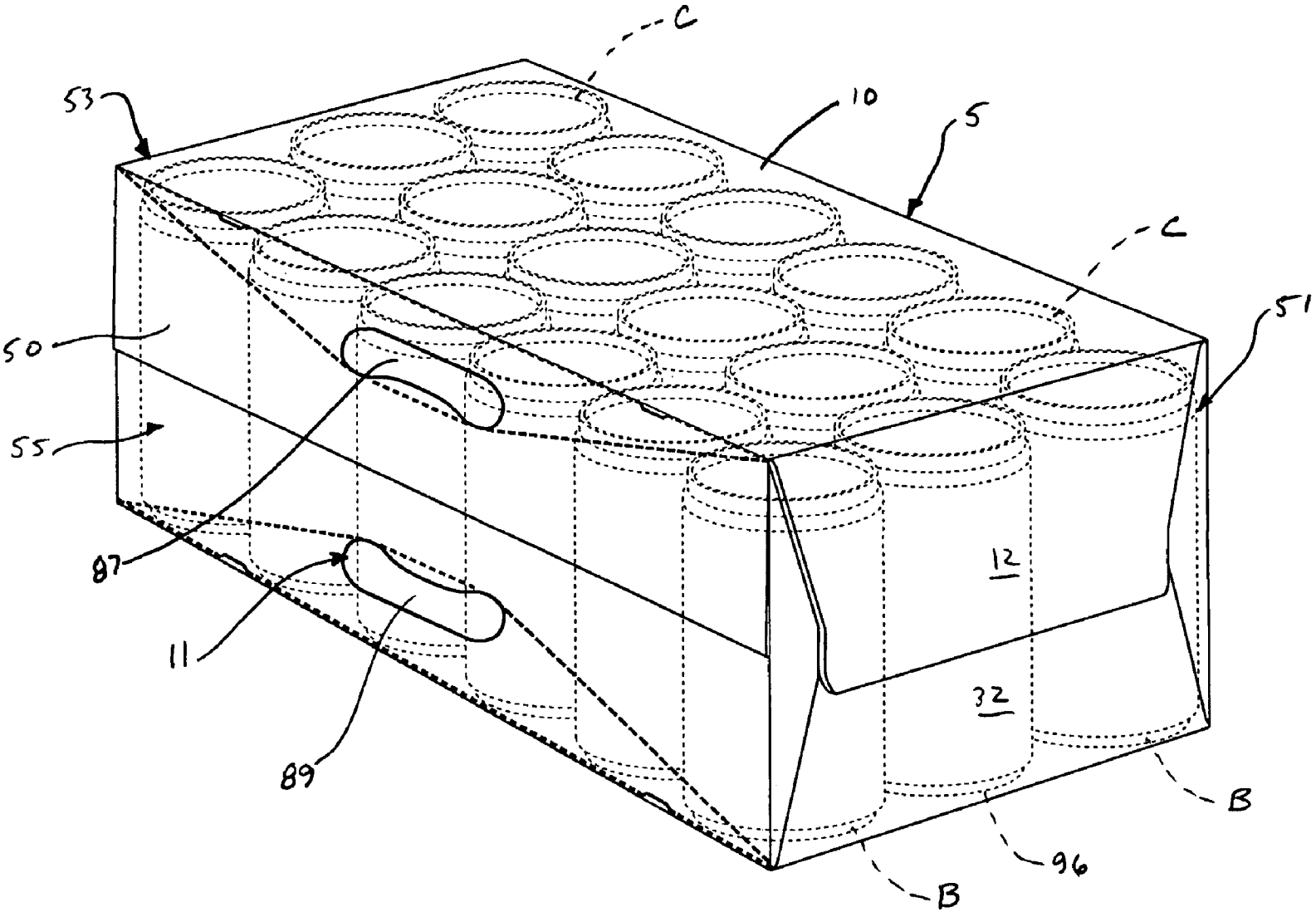
FIG. 4 is a perspective of the carton with the first and second ends closed.
Figure 5:
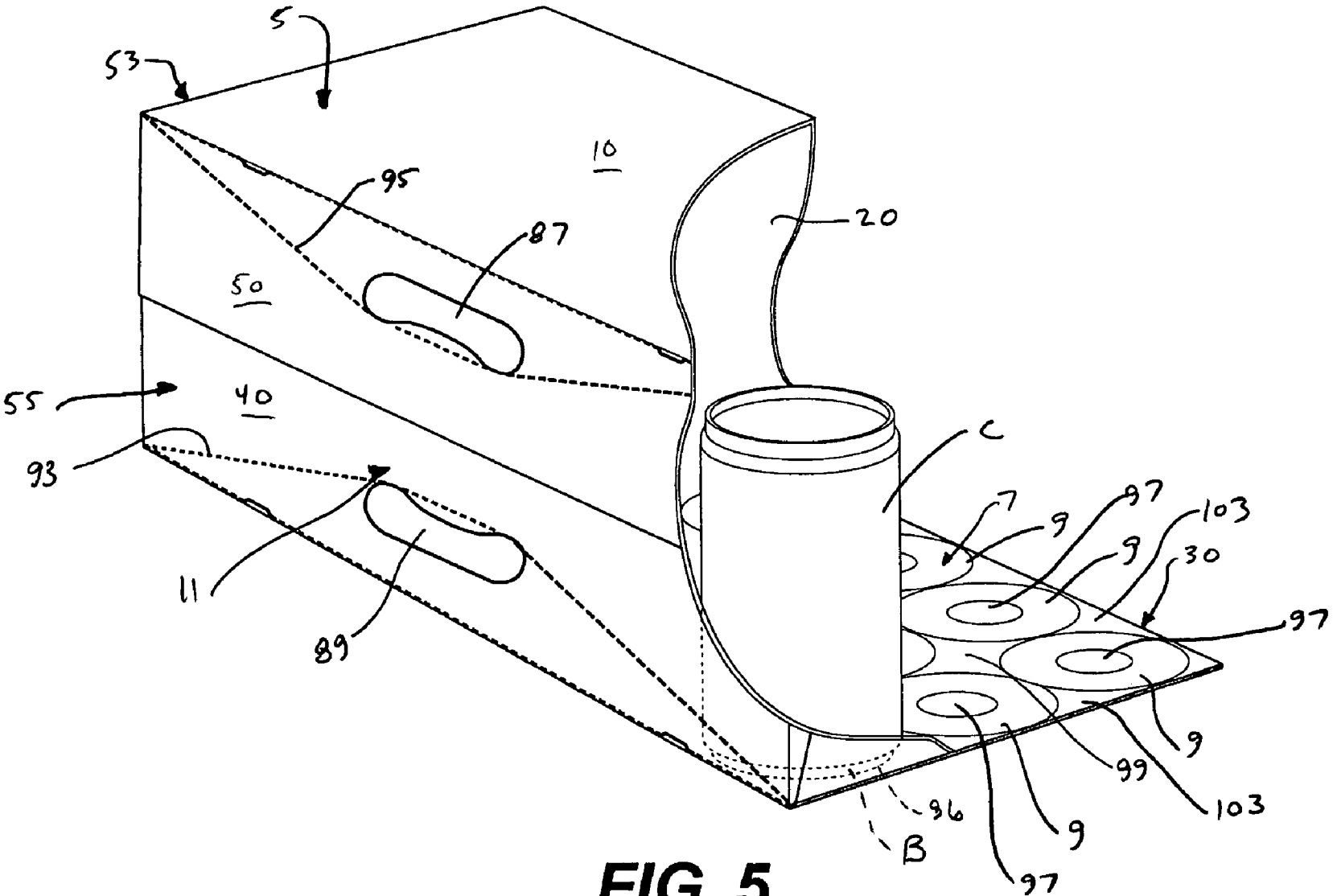
FIG. 5 is a perspective of the carton with sides of the carton partially broken away and the containers partially removed to show details of the interior of the carton.

FIG. 1 is a plan view of an interior side 1 of a blank, generally indicated at 3, used to form a carton 5 (FIG. 4) according to the exemplary embodiment of the invention. The carton 5 can be used to house a plurality of articles such as containers C (FIG. 2). The carton 5 has a protective coating, generally indicated at 7, on at least a portion of the interior side 1. The protective coating 7 comprises a plurality of protective elements 9 selectively applied to the interior side 1 and positioned for contact with the containers C in the carton 5 assembled from the blank 1. In the illustrated embodiment, the carton 5 is sized to house eighteen containers C in a single layer in a 3×6 arrangement, but it is understood that the carton 5 may be sized and shaped to hold containers of a different or same quantity in more than one layer and/or in different row/column arrangements (e.g., 3×8, 4×6, 3×4, 1×6, 2×6×2, 3×4×2, 2×9, 2×6, etc.). Also, the containers C have a bottom surface B shaped to correspond with the shape of the protective elements 9. In the illustrated embodiment, the carton 5 includes a handle, generally indicated at 11 for grasping and carrying the carton.

The blank 3 has a longitudinal axis L1 and a lateral axis L2. In the illustrated embodiment, the blank 3 comprises a top panel 10 foldably connected to a first side panel 20 at a first lateral fold line 21, a bottom panel 30 foldably connected to the first side panel 20 at a second lateral fold line 31, a second side panel 40 foldably connected to the top panel 10 at a third lateral fold line 41, and a third side panel 50 foldably connected to the bottom panel 30 at a fourth lateral fold line 52. In the illustrated embodiment, the second and third side panels 40, 50 are at least partially overlapped and adhered to form a side 55 of the carton 5 having the handle 11 formed therein. Alternatively, a single side panel could form the side 55 of the carton 5 without departing from the scope of this invention.

The top panel 10 is foldably connected to a first top end flap 12 and a second top end flap 14. The first side panel 20 is foldably connected to a first side flap 22 and a second side flap 24. The bottom panel 30 is foldably connected to a first bottom end flap 32 and a second bottom end flap 34. The second side panel 40 is foldably connected to a first side flap 42 and a second side flap 44. The third side panel 50 is foldably connected to a first side flap 46 and a second side flap 48.

When the carton 5 is erected, the top and bottom end flaps 12 and 32 and side end flaps 22, 42, and 46 close a first end 51 of the carton, and the top and bottom end flaps 14 and 34 and side end flaps 24, 44, and 48 close a second end 53 of the carton. In the illustrated embodiment, the first side flaps 42, 46 of the second side panel 40 and the third side panel 50 cooperate to form a side flap 59 at the first end 51 of the carton 5 when the second and third side panels are overlapped and adhered. Also, the second side flaps 44, 48 of the second side panel 40 and the third side panel 50 cooperate to form a side flap 61 at the second end 53 of the carton 5 when the second and third side panels are overlapped and adhered. In accordance with an alternative embodiment of the present invention, different flap arrangements can be used for closing the ends 51, 53 of the carton 5.

The top and bottom end flaps 12 and 32 and side end flaps 22, 42, and 46 extend along a first marginal area of the blank 3, and are foldably connected at a first longitudinal fold line 62 that extends along the length of the blank. The top and bottom end flaps 14 and 34 and side end flaps 24, 44, and 48 extend along a second marginal area of the blank 3, and are foldably connected at a second longitudinal fold line 64 that also extends along the length of the blank. The longitudinal fold lines 62, 64 may be, for example, substantially straight, or offset at one or more locations to account for blank thickness or for other factors.

As shown in FIG. 1, the handle 11 of the carton 5 is formed from features in the second side panel 40 and the third side panel 50. The features of the handle 11 include an elongate handle panel 87 foldably attached to the second side panel 40 and an elongate handle panel 89 foldably attached to the third side panel 50. The handle 11 includes a fold line 93 in the second side panel 40 and a fold line 95 is the third side panel 50. The handle panels 87, 89 are folded inward to create respective handle openings (not shown) in the carton 5 for grasping and carrying the carton. The fold lines 93, 95 allow the side 55 of carton 5 to flex outward when the carton 5 is grasped and lifted by the handle 11. It is understood that the handle 11 may include features that are otherwise shaped and located in the carton 5, or that the handle may be omitted from the carton, without departing from the scope of this invention.

In the illustrated embodiment, the protective elements 9 are applied to the interior 1 of the bottom panel 30 by a flexographic printing press (not shown). It is understood that the material forming the protective elements 9 may be applied by other conventional application processes (e.g., rotogravure printing, screen coating, meyer rod coating, curtain coating, spray application, brush application, etc.) without departing from the scope of this invention.

The protective elements 9 can include any suitable material capable of protecting the material of the carton 5 from abrasive contact with the containers C and/or any suitable water-resistant material. For example, the protective elements 9 can comprise a material that is liquid impermeable, as well as abrasion resistant, such as polyethylene, so that water is not transmitted through the bottom panel 30 of the carton 5 in the areas where the protective elements are applied. The material is a printable material applied thick enough to impart a 'film-like' quality to the coated surface, though the material can be otherwise applied, depending on coating requirements. In one embodiment, the material for the protective elements 9 is a polymer emulsion. Suitable polymer emulsions include, but are not limited to, vinyl acetate-ethylene polymer, ethylene-vinyl chloride polymer, vinyl acetate homopolymer, vinyl acrylic polymer, polyethylene polymer emulsion, and acrylic polymer, or other suitable materials. In one embodiment, the coating material forming the protective elements 9 is applied to the inner surface of the bottom panel 30 of the paperboard blank 3 such that the material is absorbed into the pores of the blank material to coat the fibers of the blank material. The coating of the fibers of the blank material prevents water from passing through the carton 5 formed from the blank 3 where the protective elements 9 are applied. Therefore, any water passing through the material of the carton 5 must pass through the material of the carton that has not been applied with the coating material forming the protective elements 9. When the coating material forming the protective elements 9 is applied to the blank material and at least partially absorbed therein, a thin film of the water-resistant and/or abrasion resistant coating material may protrude from the inner surface of the bottom panel 30. Alternatively, the coating material forming the protective elements 9 may be applied in a manner so that the material is substantially flush with the inner surface of the bottom panel 30.

Figure 1A:
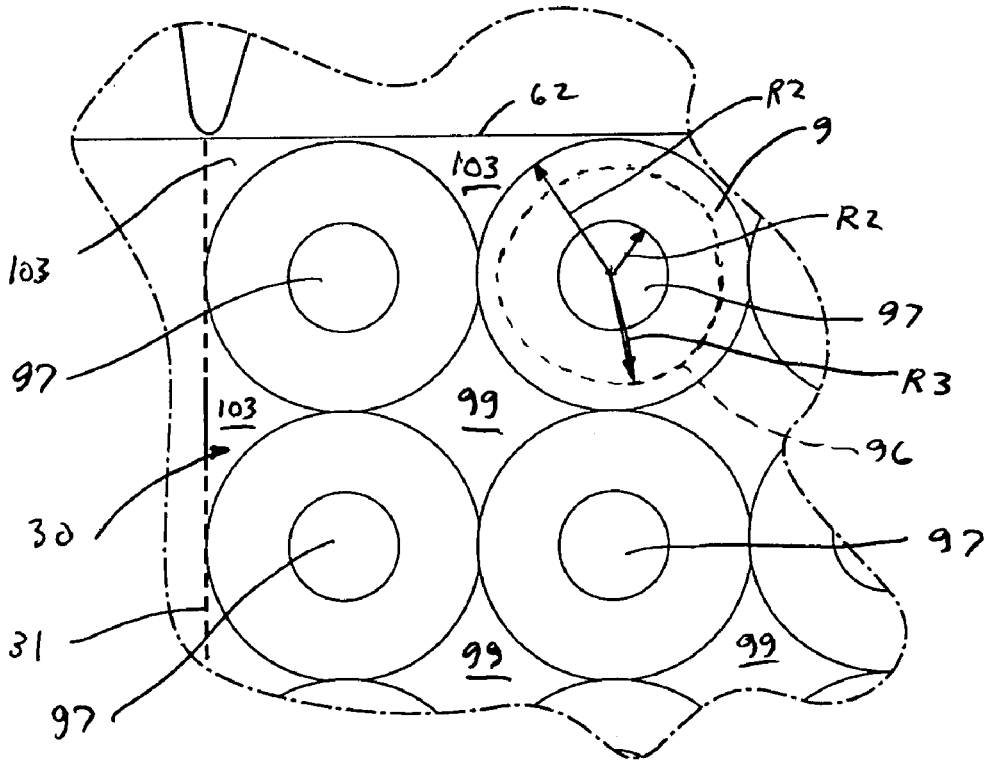
FIG. 1A is an enlarged portion of FIG. 1.

In the illustrated embodiment, the protective elements 9 are annular shaped and are located on the interior surface 1 of the bottom panel 30. The protective elements 9 are shaped to correspond with the shape and location of the bottom surface B of the containers C when the containers are loaded in the carton 5. As shown in FIG. 1, the protective elements 9 are arranged in three rows of six elements that correspond with the arrangement of the containers C in the carton 5. As shown in FIG. 1A, the protective elements 9 have an inner radius R1 and an outer radius R2. The containers C are cylindrical containers (e.g., cans) with the bottom portion B of the containers including a circular bottom contact surface 96 having a radius R3. The location of the contact surface 96 of the bottom portion B of the cans C is shown in dashed lines for exemplary purposes in FIG. 1A to illustrate the approximate location of the cans on the contact elements 9 when the cans are inserted into the carton 5 assembled from the blank 1.

In one exemplary embodiment, the protective elements 9 are rings having an inner radius R1 of approximately 0.5 inches and an outer radius R2 of approximately 1.4 inches. In one embodiment, the containers C have a bottom portion B with a contact surface 96 having a radius R3 of approximately 0.9 inches. In the illustrated embodiment, the rings 9 at least partially are overlapped with respect to one another. In one embodiment, the radius R1 may be in the range of approximately 0 inches to approximately 1.5 inches, and the radius R2 may be in the range of approximately 0.5 inches to approximately 2.5 inches. In other embodiments, the radii R1 and R2 may very from the aforementioned ranges. The dimensional information described herein is intended to be illustrative of one embodiment of the invention and should not be construed as limiting the scope of the invention because the dimensions of the invention may vary from the dimensions and ranges described herein without departing from the scope of this invention.

The protective elements 9 and the containers C may be otherwise shaped and arranged without departing from the scope of this invention. For example, the protective elements 9 may be square or rectangular corresponding to square or rectangular-shaped containers C. The protective elements 9 and the containers C may be any other shape without departing from the scope of the invention.

As shown in FIGS. 1 and 1A, the bottom panel 30 includes uncoated areas of the carton 5 that are free from coverage by the protective elements 9. The uncoated areas include a circular portion 97 in the center of each respective protective element 9, portions 99 between adjacent protective elements, and portions 103 between the outer protective elements and the fold lines 31, 52, 62, 64. The uncoated portions 97, 99, 103 on the bottom panel 30 allow moisture that is present in the carton 5 to pass through the material of the bottom panel and permeate from the interior of the carton to the exterior of the carton. The passage of moisture from the interior of the carton 5 to the exterior of the carton lowers the relative humidity in the sealed carton. Also, the protective elements 9 seek to prevent the bottom panel 30 of the carton 5 from being cut, deformed, or otherwise damaged from the contact between the bottom contact surface 96 of the containers C and the bottom panel of the carton.

In accordance with the exemplary embodiment, the blank 3 can be erected into the carton 5 by folding along fold lines 21, 31, 41, and 52 and adhering the second side panel 40 to the third side panel 50 to form a sleeve 141 (FIG. 2). The blank 3 may be otherwise configured to have multiple top panels and/or multiple bottom panels without departing from the scope of this invention.

In the illustrated embodiment, the first end 51 of the carton 5 is closed by respectively overlapping and adhering the side end flaps 22, 42, 46 and the top and bottom end flaps 12, 32 after the containers C are inserted into the carton. The second end 53 of the carton 5 is closed by respectively overlapping the side end flaps 24, 44, 48 and top and bottom end flaps 14, 34. Once the blank 3 is formed into the sleeve 141, the containers C may be loaded in the carton 5 from the first end 51 and then the first end may be closed by overlapping and gluing the side end flaps 22, 42, 46 and top and bottom end flaps 12, 32 and then the second end may be closed by overlapping and gluing the side end flaps 24, 44, 48 and top and bottom end flaps 14, 34. Alternative loading and closing steps may be used without departing from the scope of this invention.

A method of protecting the carton 5 is provided by providing the blank 3 and coating the bottom panel 30 with a protective coating 7 including the plurality of protective elements 9 which are selectively applied to the interior surface 1 of the blank. The blank 3 is formed into the sleeve 141 as discussed above. The plurality of containers C are placed into the sleeve such that the bottom contact surface 96 of each container contacts a respective protective element 9. The sleeve 131 can be closed to form a closed first and second end 51, 53 of the carton 5 in the manner discussed above.

The coating 7 of the present invention can be applied to any size blank to be formed into any size carton to enclose any number of containers. Also, the protective elements 9 may be applied to both the bottom panel 30 and top panel 10 without departing from the scope of this invention. Further the protective elements 9 may be shapes other than annular without departing from this invention.

Figure 6:
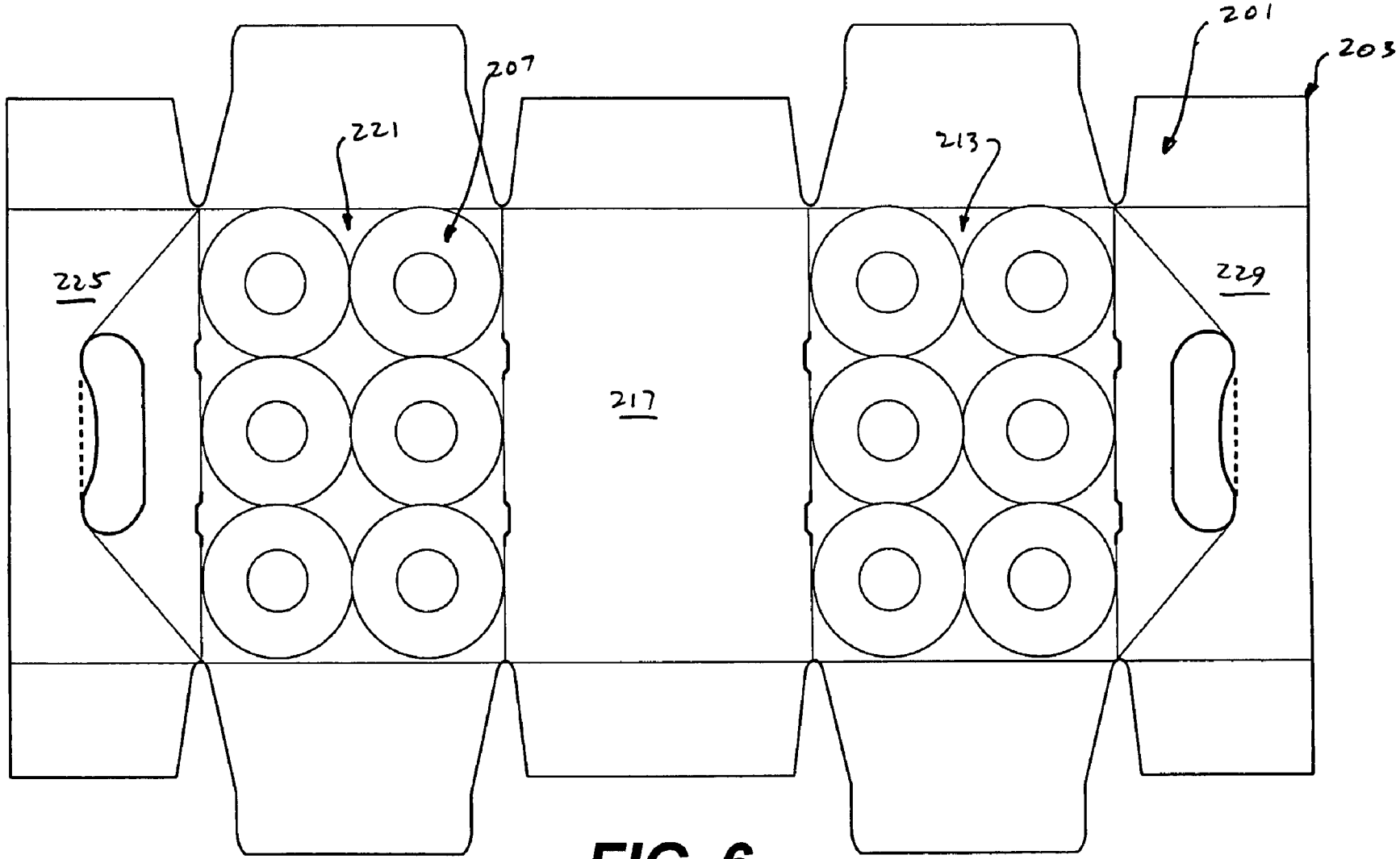
FIG. 6 is a plan view of a blank used to form a carton according to a second embodiment of the invention.

FIG. 6 illustrates an interior surface 201 of a second embodiment of a blank 203 that is sized for containing six containers C. The blank includes a bottom panel 213, a first side panel 217, a top panel 221, a second side panel 225, and a third side panel 229. The blank 201 has a protective coating 207 forming protective elements 209 on the bottom panel 213 and a protective coating 231 forming protective elements 235 on the top panel 221. In this embodiment, the protective elements 209, 235 are similar in size, shape, and material as the protective elements 9 of the first embodiment. The protective elements 209 are positioned on the bottom panel 213 so as to contact the bottom surface of the containers C when the containers are inserted into a carton formed from the blank 203. The protective elements 235 are positioned on the top panel 221 so as to contact the top surface of the containers C when the containers are inserted into a carton formed from the blank 203. The protective elements 209, 235 could be otherwise sized, shaped, and located without departing from the scope of this invention. Further, the blank 203 may be otherwise sized and shaped to accommodate more or less than six containers without departing from the invention.

The blank according to the present invention can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank. In accordance with the above-described embodiments, the blank may be constructed of paperboard of a caliper such that it is heavier and more rigid than ordinary paper. The blank can also be constructed of other materials, such as cardboard, hard paper, or any other material having properties suitable for enabling the carton to function at least generally as described above. The blank can also be laminated to or coated with one or more sheet-like materials at selected panels or panel sections.

In accordance with the above-described embodiments of the present invention, a fold line can be any substantially linear, although not necessarily straight, form of weakening that facilitates folding therealong. More specifically, but not for the purpose of narrowing the scope of the present invention, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features The above embodiments may be described as having one or more panels adhered together during erection of the carton embodiments, and the adhering can be carried out with glue or other means for attaching. The term "glue" is intended to encompass all manner of adhesives commonly used to secure carton panels in place.

The foregoing description of the invention illustrates and describes the present invention. Additionally, the disclosure shows and describes only selected embodiments of the invention, but it is to be understood that the invention is capable of use in various other combinations, modifications, and environments and is capable of changes or modifications within the scope of the inventive concept as expressed herein, commensurate with the above teachings, and/or within the skill or knowledge of the relevant art.

What is claimed is:

1. A carton containing a plurality of articles, the carton comprising:

a plurality of panels that extend at least partially around an interior of the carton, the plurality of panels comprising a top panel, a bottom panel, a first side panel, and a second side panel, at least one panel of the plurality of panels comprising a protective coating, the coating comprising a plurality of discrete protective elements selectively applied to an interior surface of the at least one panel, the protective coating comprising a film that is at least partially absorbed into a material of the at least one panel; and a plurality of uncoated portions of the interior surface of the at least one panel, wherein the plurality of uncoated portions are free from coverage by the protective elements and are interspersed with the plurality of protective elements, and the plurality of uncoated portions are for the transmission of moisture from the interior of the carton to the exterior of the carton;

wherein each protective element of the plurality of protective elements is respectively sized and positioned for contact with a respective bottom surface of an article of the plurality of articles prior to inserting the plurality of articles into the interior of the carton;

wherein each of the articles is in contact with a respective discrete protective element of the plurality of protective elements, and each respective discrete protective element is in contact with a single article of the plurality of articles and is free from contact with adjacent articles of the plurality of articles;

wherein each of the protective elements comprises a ring, and each of the protective elements is in contact with at least one adjacent protective element.

2. The carton of claim 1 wherein the rings are at least partially overlapped with respect to one another.

3. The carton of claim 1 wherein said at least one panel comprises the bottom panel.

4. The carton of claim 1 wherein the protective elements are arranged in rows and columns.

5. The carton of claim 1 wherein the protective coating comprises an abrasion resistant material to prevent the articles from damaging the at least one panel.

6. The carton of claim 1 wherein the protective coating comprises a water resistant material to restrict the passage of water through the protective elements.

7. The carton of claim 1 wherein the coating comprises polyethylene.

8. The carton of claim 1 wherein the protective elements are substantially circular.

9. The carton of claim 8, the plurality of articles comprising cylindrical containers having a bottom portion of substantially similar shape as the protective elements.

10. The carton of claim 1 further comprising at least two end flaps respectively foldably attached to respective panels of the plurality of panels, wherein the end flaps are overlapped with respect to one another and thereby at least partially form a closed end of the carton.

11. The carton of claim 1 wherein the protective coating at least partially penetrates the interior surface of the at least one panel.

12. The carton of claim 1 wherein the protective coating is substantially flush with the interior surface of the at least one panel.

13. The carton of claim 1 wherein the protective coating protrudes from the interior surface of the at least one panel.

14. The carton of claim 1 wherein the plurality of uncoated portions comprises a circular uncoated portion within each discrete protective element of the plurality of protective elements.

15. The carton of claim 14 wherein each discrete protective element comprises a circular outer edge, and each circular uncoated portion is generally concentric with each respective discrete protective element.

16. A blank for forming a carton comprising:

a plurality of panels for extending at least partially around an interior of the carton formed from the blank, the plurality of panels comprising a top panel, a bottom panel, a first side panel, and a second side panel;

at least one panel of the plurality of panels comprising a protective coating, the coating comprising a plurality of discrete protective elements selectively applied to an interior surface of the at least one panel, the protective coating comprising a film that is at least partially absorbed into a material of the at least one panel; and a plurality of uncoated portions of the interior surface of the at least one panel, wherein the plurality of uncoated portions are free from coverage by the protective elements and are interspersed with the plurality of protective elements, and the plurality of uncoated portions are for the transmission of moisture through the at least one panel;

wherein the carton formed from the blank is for containing a plurality of articles, and each protective element of the plurality of protective elements is respectively sized and positioned for contact with a respective bottom surface of an article of the plurality of articles prior to inserting the plurality of articles into the interior of the carton formed from the blank wherein each of the protective elements comprises a ring, and each of the protective elements is in contact with at least one adjacent protective element.

17. The blank of claim 16 wherein the rings are at least partially overlapped with respect to one another.

18. The blank of claim 16 wherein said at least one panel comprises the bottom panel.

19. The blank of claim 16 wherein the protective elements are arranged in rows and columns.

20. The blank of claim 16 wherein the protective coating comprises an abrasion resistant material to prevent the articles from damaging the at least one panel.

21. The blank of claim 16 wherein the protective coating comprises a water resistant material to restrict the passage of water through the protective elements.

22. The blank of claim 16 wherein the coating comprises polyethylene.

23. The blank of claim 16 wherein the protective elements are annular shaped.

24. The blank of claim 16 wherein the protective elements are substantially circular.

25. The blank of claim 16 wherein the blank comprises a fibrous material and the protective coating is absorbed into the fibrous material and coats fibers of the fibrous material.

26. The blank of claim 16 wherein the protective coating is substantially flush with the interior surface of the at least one panel.

27. The blank of claim 16 wherein the protective coating protrudes from the interior surface of the at least one panel.

28. The blank of claim 16 wherein the plurality of uncoated portions comprises a circular uncoated portion within each discrete protective element of the plurality of protective elements.

29. The blank of claim 28 wherein each discrete protective element comprises a circular outer edge, and each circular uncoated portion is generally concentric with each respective discrete protective element.

30. A carton containing a plurality of articles, the carton comprising:

a plurality of panels that extend at least partially around an interior of the carton, the plurality of panels comprising a top panel, a bottom panel, a first side panel, and a second side panel, at least one panel of the plurality of panels comprising a protective coating, the coating comprising a plurality of discrete protective elements selectively applied to an interior surface of the at least one panel, the protective coating comprising a film that is at least partially absorbed into a material of the at least one panel, and the protective elements comprise rings that are at least partially overlapped with respect to one another, wherein each protective element of the plurality of protective elements is respectively sized and positioned for contact with a respective bottom surface of an article of the plurality of articles prior to inserting the plurality of articles into the interior of the carton;

wherein each of the articles is in contact with a respective discrete protective element of the plurality of protective elements, and each respective discrete protective element is in contact with a single article of the plurality of articles and is free from contact with adjacent articles of the plurality of articles.

31. A blank for forming a carton comprising:

a plurality of panels for extending at least partially around an interior of the carton formed from the blank, the plurality of panels comprising a top panel, a bottom panel, a first side panel, and a second side panel, at least one panel of the plurality of panels comprising a protective coating, the coating comprising a plurality of discrete protective elements selectively applied to an interior surface of the at least one panel, the protective coating comprising a film that is at least partially absorbed into a material of the at least one panel, and the protective elements comprise rings that are at least partially overlapped with respect to one another, wherein the carton formed from the blank is for containing a plurality of articles, and each protective element of the plurality of protective elements is respectively sized and positioned for contact with a respective bottom surface of an article of the plurality of articles prior to inserting the plurality of articles into the interior of the carton formed from the blank.

* * * * *